US006328100B1

(12) United States Patent
Haussmann

(10) Patent No.: US 6,328,100 B1
(45) Date of Patent: Dec. 11, 2001

(54) HEAT EXCHANGER WITH RIBBED FLAT TUBES

(75) Inventor: Roland Haussmann, Wiesloch (DE)

(73) Assignee: Valeo Klimasechnick GmbH & Co KG (DE)

( * ) Notice: Subject to any disclaimer, the term of this patent is extended or adjusted under 35 U.S.C. 154(b) by 0 days.

(21) Appl. No.: 09/708,322

(22) Filed: Mar. 12, 2001

Related U.S. Application Data

(63) Continuation of application No. 09/327,074, filed on Jun. 7, 1999, now abandoned.

(30) Foreign Application Priority Data

Jun. 8, 1998 (DE) ..... 198 25 561

(51) Int. Cl.[7] ..... F28B 7/06
(52) U.S. Cl. ..... 165/176; 165/140; 165/153
(58) Field of Search ..... 165/153, 140, 165/173, 175, 176, 148; 123/196 AB, 41.1

(56) References Cited

U.S. PATENT DOCUMENTS

| | | | | |
|---|---|---|---|---|
| 1,948,929 | | 2/1934 | MacPherson | 165/140 |
| 4,190,105 | | 2/1980 | Dankowski | 165/179 |
| 4,947,931 | * | 8/1990 | Vitacco | 165/148 |
| 5,009,262 | | 4/1991 | Halstead et al. | 165/140 |
| 5,033,540 | | 7/1991 | Tategami et al. | 165/140 |
| 5,318,114 | | 6/1994 | Sasaki | 165/176 |
| 5,526,873 | | 6/1996 | Marsais et al. | 165/140 |
| 5,582,239 | | 12/1996 | Tsunoda et al. | 165/76 |
| 5,605,191 | * | 2/1997 | Eto et al. | 165/176 |
| 6,161,161 | * | 12/2000 | Haussmann | 165/153 |
| 6,173,766 | * | 1/2001 | Nakamura et al. | 165/176 |
| 6,202,741 | * | 3/2001 | Demuth et al. | 165/176 |
| 6,230,793 | * | 5/2001 | Sumida | 165/140 |

FOREIGN PATENT DOCUMENTS

| | | | |
|---|---|---|---|
| 44 46 817 | 7/1995 | (DE) | F25B/39/02 |
| 44 36 791 | 4/1996 | (DE) | F28D/21/00 |
| 195 15 528 | 10/1996 | (DE) | F28F/9/00 |
| 583814 | 1/1944 | (GB) | 878/44 |

* cited by examiner

*Primary Examiner*—Ira S. Lazarus
*Assistant Examiner*—Terrell McKinnon
(74) *Attorney, Agent, or Firm*—Morgan & Finnegan, LLP

(57) ABSTRACT

In the heat exchanger for motor vehicles with ribbed flat tubes, the tube interior space thereof is each connected with headers, a first of which is arranged in the region of the first ends and a second is arranged in the region of the second ends of the flat tubes. The internal heat exchange fluid can be admitted to the flat tubes in an individual or group-wise sequence alternately at their first ends from the first header and at their second ends from the second header by each header comprising a supply and a return of the corresponding heat exchange fluid. The ends of the flat tubes opposed to their header have a U-shaped flow reverse in the flat tube.

6 Claims, 3 Drawing Sheets

HEAT EXCHANGER WITH RIBBED FLAT TUBES

This is a continuation of application Ser. No. 09/327,074 filed Jun. 7, 1999, now abandoned.

BACKGROUND OF THE INVENTION

The invention relates to a heat exchanger, preferably a heat exchanger in heating installations, an engine radiator, a liquefier or condenser or an evaporator, for motor vehicles with ribbed flat tubes with the further features of the preamble of claim 1.

In such heat exchangers, it is common (cf. e.g. U.S. Pat. No. 5,174,373) to arrange a header each in the region of both ends of the ribbed flat tubes and in the process to conduct an internal heat exchange fluid of the flat tubes from the one header through the respective tube interior space of the flat tubes to the other header.

It is also already known (cf. e.g. DE 44 46 817 A1) to only use one header provided with a supply and a return to which the respective ribbed flat tube is connected in a multi-flow design with its interior space, the ends of the flat tubes facing away from the header being provided with a deflection device for the flows.

Finally, it is e.g. known from the combination of a water cooler of an engine radiator circulation and a liquefier or condenser of a motor vehicle conditioning system, an engine oil cooler or a charge cooling system, to arrange heat exchangers to which various internal heat exchange fluids are admitted in the flow direction of the external heat exchange fluid, in motor vehicles in most cases ambient air, one behind or next to the other (DE-G 91 11 412.8 U1). Such a multifunctional arrangement requires—apart from the constructional effort for several heat exchangers which in particular shows in the material and manufacturing costs—for their arrangement, too, a relatively great space, which is especially critical in particular in case of an arrangement in motor vehicles.

BRIEF SUMMARY OF THE INVENTION

The object underlying the invention is to further optimize such a multifunctional arrangement for motor vehicles with respect to the material, the manufacturing and in particular the space requirements at least for certain cases of application.

This object is achieved by the heat exchangers with the features of claim 1. In this case, the functions of two heat exchangers to which two different internal heat exchange fluids can be admitted are integrated in one single heat exchanger. The desired optimization is achieved in an especially favourable manner if the two different heat exchange functions are utilized in a chronological order, in which case then the ribbing of the flat tubes which is not needed for the present heat exchange function supplements the ribbing of the flat tubes active for the present heat exchange function for the heat exchange with the external heat exchange fluid. In this case, it can even suffice to design the complete ribbing of the heat exchanger only in accordance with the one heat exchange function, which requires a maximal external heat exchange surface. That is, in a borderline case one can even halve the external ribbing with respect to the known individual heat exchangers. In each case, in the manufacturing process, for several functions only a single type of heat exchangers has to be made and arranged in the motor vehicle when assembling it, which results in a considerable saving of material, manufacturing and assembling costs. The required space for the assembly in the motor vehicle, too, can be kept to a minimum in the above mentioned context.

The subclaims 2 to 6 concern preferred further developments of the invention.

BRIEF DESCRIPTION OF THE DRAWINGS

The invention will be illustrated more in detail with schematic drawings by means of several embodiments as follows, wherein.

DETAILED DESCRIPTION OF THE INVENTION

Figure 1:
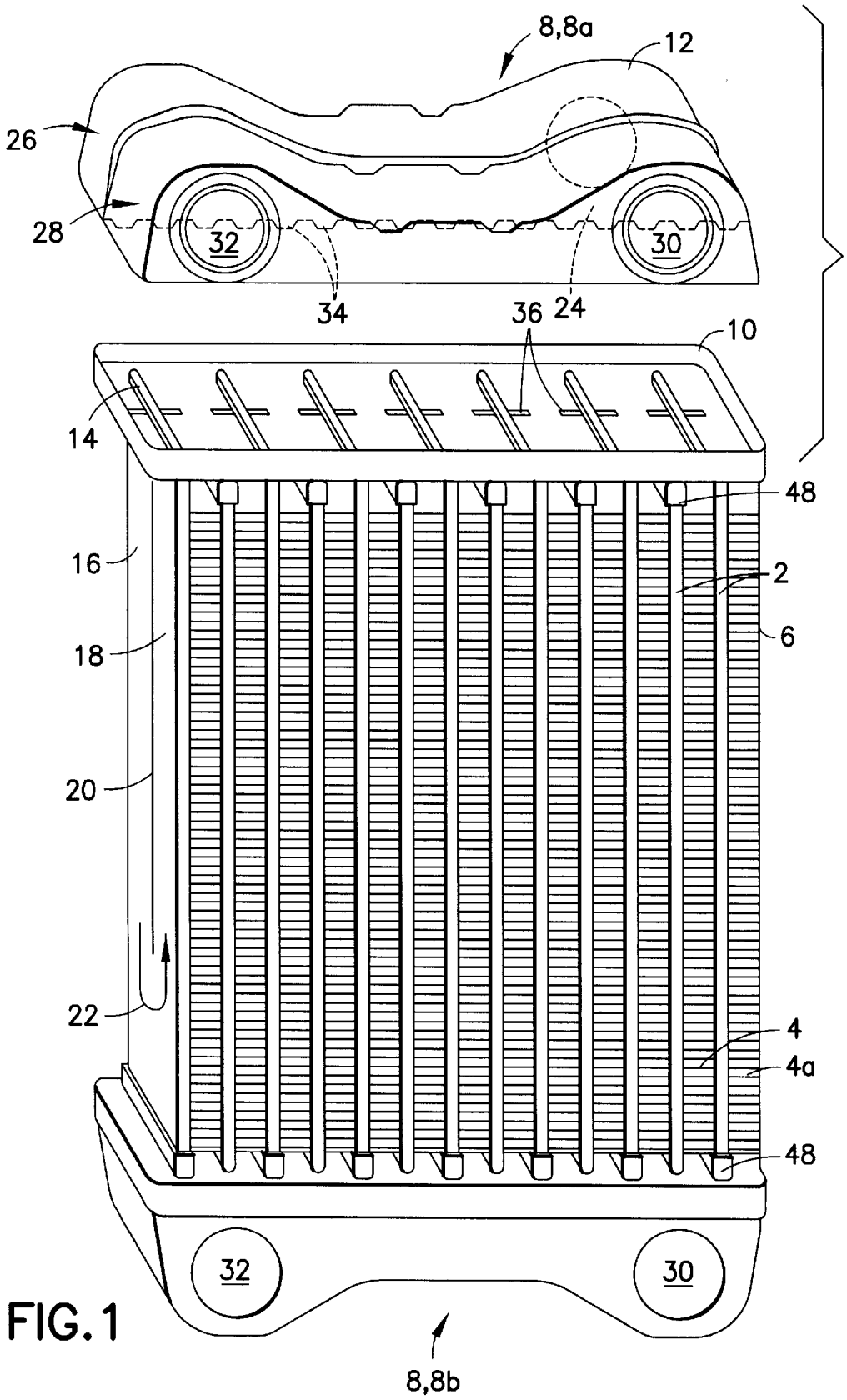
FIG. 1 shows a plan view in the direction of the flow of ambient air as the external heat exchange fluid of an embodiment of a heat exchanger according to claim 1 in a partly sectional and partly exploded representation.

In all represented heat exchangers, a block of flat tubes 2 arranged in parallel to one another is provided comprising a common ribbing by zig zag fins 4, which join at least the flat sides of the flat tubes 2. In addition, furthermore a corresponding ribbing 4*a* can be provided at the external flat side of an external flat tube 2 each, which is joined by an external lateral end sheet metal 6.

All embodiments furthermore have in common that a group of flat tubes 2 communicates with a header 8, which is composed of two parts, i.e. a tube bottom or tube plate 10 and a cap 12. The tube bottom comprises insertion slits 14 for a free end each of the flat tubes 2 communicating with the corresponding header'10. In this case, the flat tubes have a double-flow design. The first flow 16 in the flow direction of the internal heat exchange fluid here extends in the flow countercurrent to the second flow 18 within the flat tube, the flat tube 2 comprising a partition 20 between the two flows 16 and 18. The arrow 22 in FIGS. 1 and 2 here illustrates the flow reverse of the two flows within the flat tube.

The cap 12 itself of the header 8 is subdivided into a compartment 26 on the inlet side and a compartment 28 on the outlet side by a parting wall 24. The compartment 26 on the inlet side is in this case provided with a lateral supply 30 at the cap 12 and communicates within the header 8 with the first flow 16. The compartment 28 on the outlet side also comprises at the one side of the cap 12, in this case on the same side without restricting the generality, a return 32 of the internal heat exchange fluid and communicates within the header 8 with the respective second flow 18.

Without wanting to further go into the details of the structure of the respective header 8, in FIG. 1 it is additionally represented that at least the parting wall 24 in the header 8 can comprise tongues 34 which can engage grooves or slits 36 extending longitudinally of the tube bottom 10.

In the described type of construction, all components preferably consist of aluminum or an aluminum alloy, such as AlMnl, and are brazed to one another thus sealing the respective partitions.

In the embodiment of FIG. 1, a header 8*a* and 8*b* each is arranged in the region of the two ends of the flat tubes 2, different types of an internal heat exchange fluid being admitted to both headers. Here, in particular the chemical type of the heat exchange fluids can vary. However, one can also take into consideration to only select one different parameter of the internal heat exchange fluid, such as for instance the operation temperature.

In the embodiment according to FIG. 1, here subsequent flat tubes 2 are connected to the header 8*a* or to the header 8*b* in an alternate communication.

Figure 3:
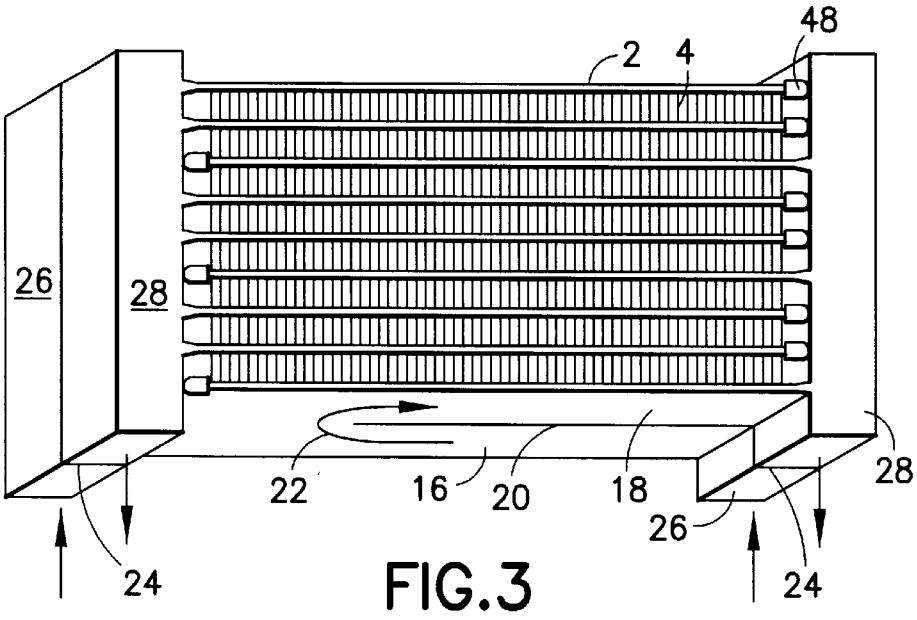
FIG. 3 shows a functional view of a heat exchanger according to FIG. 1, and FIGS. 4 and 5 show partial sections of a heat exchanger according to FIG. 1 in the longitudinal direction of the flat tubes with a representation of various types of end closures at the ends of the flat tubes facing away from their header.

This sequence of connection, however, can also be effected in another rhythm, i.e. instead of the alternating connection according to FIG. 3 one can alternate a connection each to only one flat tube and a connection each to a parallel arrangement of two flat tubes without restricting the generality. Any other assignment of individual connections and/or connections in groups is here also possible within the scope of the invention.

The design and the type of connection of the two headers 8*a* and 8*b* according to FIG. 1 are here equal, such that the header 8*b* does not have to be described separately.

Figure 4:
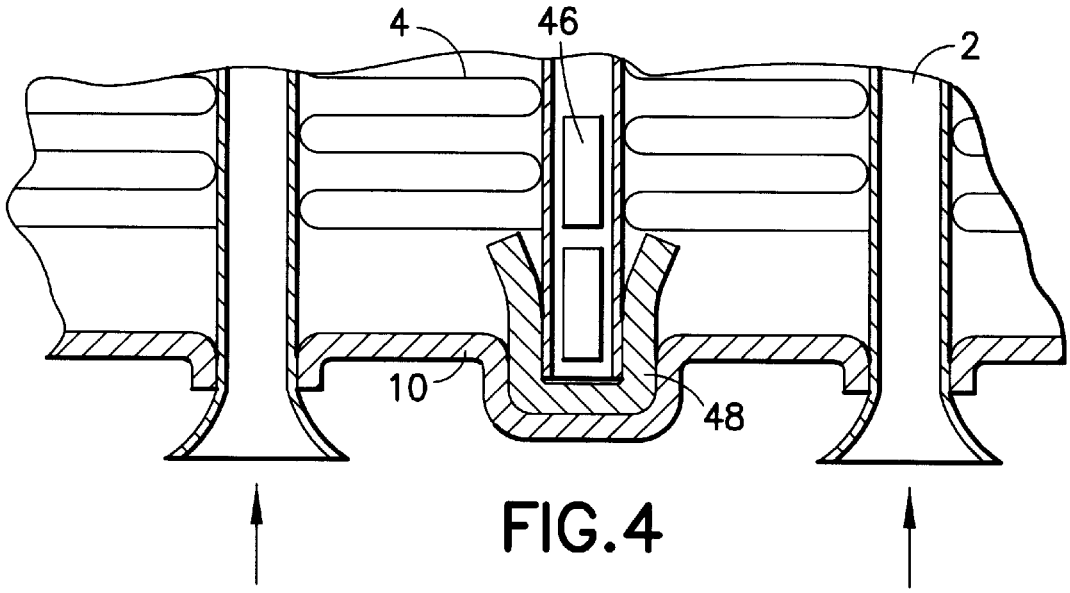
Figure 5:
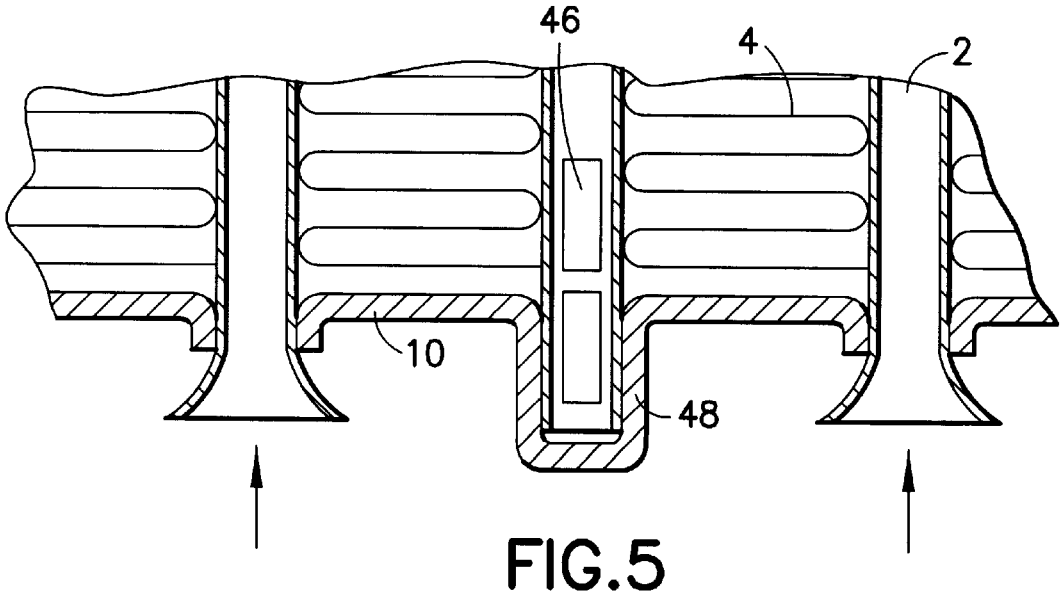

Again without restricting the generality, FIGS. 3, 4 and 5 describe three particularly preferred embodiments of the design and arrangement of the flat tubes 2 admitting an internal heat exchange fluid in the deflection region of the flows.

Figure 2:
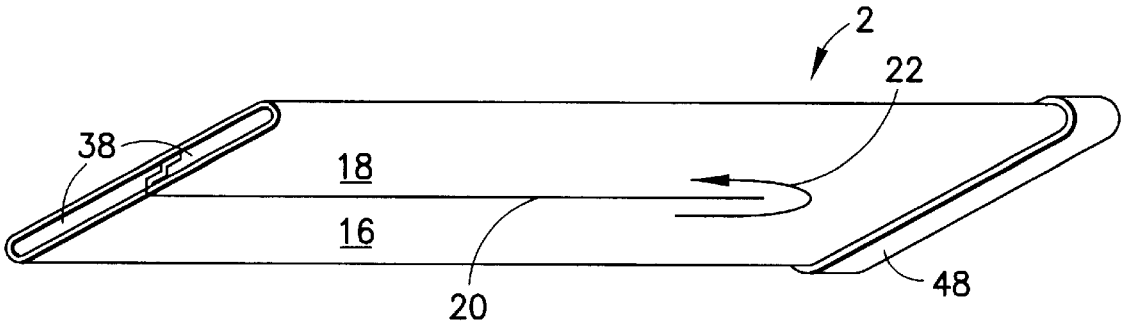
FIG. 2 shows a functional view of an individual flat tube in which the ribbing is omitted.

The deflection of the flows can in this case be completely or partly effected in the flat tube 2 itself, as is represented by means of two alternatives in FIG. 2 on the one hand and in FIGS. 4 and 5 on the other hand. In the primarily schematic representation of FIG. 2, one can also concretely recognize such an embodiment, in which at the end of the respective flat tube 2 the partition 20 is completely omitted. As an alternative, this partition 20 can also be designed with openings 46 acting as flow connections analogous to FIGS. 4 and 5, in this case a number of two openings being represented, which, however, can also be replaced by a single opening or a number of openings 46 higher than two.

If the deflection between the two flows is effected exclusively analogous to FIG. 2 or FIGS. 4 or 5 within the flat tube, it suffices to simply terminate the respective flat tube at the end not communicating with its header 8, e.g. by clamping and brazing. The embodiments according to FIGS. 2, 4 and 5 show instead an end closing of the respective flat tube 2 by means of a separate bowl-like element 48. The arrangement thereof offers the possibility to even do completely without a deflection of the flows in the flat tube itself and instead to effect the deflection exclusively in the corresponding bowl-like element 48. However, one can also realize a mixture between the two embodiments, in which the deflection is effected partly within the flat tube and partly within the bowl-like element. The arrangement in which the deflection is only effected in the flat tube and the corresponding bowl-like element 48 is only provided for terminating the front side of the corresponding flat tube 2 is meant to be a preferred arrangement within the scope of the representation.

In the embodiment according to FIG. 2, the bowl-like element 48 is covered over a free end of the corresponding flat tube 2. FIG. 4 shows the characteristic feature for this case that the bowl-like element 48 is clamped between the free end of the corresponding flat tube 2 and the tube bottom 10 of the geometrically subsequent header 8 or 8*a* or 8*b*, respectively, such that also by means of this clamping a brazing between the respective free end of the flat tube 2 and the tube bottom 10 can be effected. In contrast, FIG. 5 shows a modification in which one does without the separate design and arrangement of the bowl-like component 48 and the function thereof is taken over by a corresponding bowl-like design of the tube bottom 10.

Finally, in FIG. 2 it is represented that within the scope of the invention preferably such flat tubes 2 are used which are folded from a flat material, such that during the folding process also the partition 20 of the flat tube is obtained. This becomes particularly clear in the section to be seen in the left in FIG. 2 through the free end of the corresponding flat tube 2, where the partition 20 is also formed by an end zone of the original flat material.

Heat exchanger with ribbed flat tubes, preferably heat exchanger in heating installations, engine radiator, liquefier or condenser or evaporator, for motor vehicles

What is claimed is:

1. A heat exchanger, preferably heat exchanger in heating installations, engine radiator, liquefier or condenser or evaporator, for motor vehicles with ribbed flat tubes, an internal heat exchange fluid communicating with the tube interior space via headers being admitted to the tube interior space of the flat tubes, a first header of which being arranged in the region of the first ends and a second header of which being arranged in the region of the second ends of the flat tubes, the internal heat exchange fluid can be admitted to the flat tubes in a sequence individually or in groups alternately at their first from the first header and at their second ends from the second header, the first header comprises a supply and a return of a first heat exchange fluid and the second header comprises a supply and a return of a second heat exchange fluid different from the first one, and the ends of the flat tubes opposite to their header are provided with a U-shaped flow reverse in the flat tube such that the U-shape flow reverse has a partition defining at least one opening thereon for assisting in the flow reverse.

2. A heat exchanger according to claim 1, wherein for the flow reverse a reversing device is attached to the free end of the flat tube.

3. A heat exchanger according to claim 1, wherein the partition is between adjacent countercurrent flows of the same flat tube and beyond the flow reverse the end of the flat tube is closed.

4. A heat exchanger according to claim 3, characterized by end closures for the ends of the flat tubes which end closures are not integral with the flat tubes.

5. A heat exchanger according to claim 4, characterized by closing caps and/or closing plugs.

6. A heat exchanger according to claim 4, wherein the end closures are also comprised in the tube bottom of a header which is provided for the admission of other flat tubes by an internal heat exchange fluid.

* * * * *

UNITED STATES PATENT AND TRADEMARK OFFICE

CERTIFICATE OF CORRECTION

PATENT NO. : 6,328,100 B1
DATED : December 11, 2001
INVENTOR(S) : Roland Haussmann It is certified that error appears in the above-identified patent and that said Letters Patent is hereby corrected as shown below:

Title page,
Item [73], assignee name, "Klimasechnick" should read -- Klimatechnik --.
Item [22], in the filing date, "Mar. 12, 2001" should read -- Nov. 8, 2000 --.

Column 4,
Line 33, after "first" and before "from", insert -- ends --.

Signed and Sealed this

Third Day of December, 2002

JAMES E. ROGAN
*Director of the United States Patent and Trademark Office*